United States Patent [19]

Lawrence

[11] Patent Number: 4,799,593

[45] Date of Patent: Jan. 24, 1989

[54] PACKAGING CONSTRUCTION

[75] Inventor: Jack Lawrence, Longfield, England

[73] Assignee: Unilever Patent Holdings B.V., Rotterdam, Netherlands

[21] Appl. No.: 856,983

[22] Filed: Apr. 29, 1986

[30] Foreign Application Priority Data

Apr. 29, 1985 [GB] United Kingdom ..... 8510849

[51] Int. Cl.[4] ..... B65D 85/30

[52] U.S. Cl. ..... 206/585; 206/586; 206/821; 206/593

[58] Field of Search ..... 206/321, 322, 386, 453, 206/491, 497, 499, 503, 585, 586, 821, 593; 229/166, 918

[56] References Cited

U.S. PATENT DOCUMENTS

| | | | |
|---|---|---|---|
| 1,640,691 | 8/1927 | Clark | 206/453 |
| 1,877,786 | 9/1932 | Arata et al. | 206/453 |
| 2,778,489 | 1/1957 | Shoemaker | 206/322 |
| 2,896,781 | 7/1959 | Domarest | 206/322 |
| 2,896,833 | 7/1959 | Markham | 206/453 |
| 2,905,114 | 9/1959 | Olson | 206/821 |
| 2,934,251 | 4/1960 | Kramer | 206/586 |
| 3,136,473 | 6/1964 | Kieffer | 229/166 |
| 3,442,436 | 5/1969 | Kirby | 206/497 |
| 3,443,684 | 5/1969 | Taylor | 206/586 |
| 3,473,654 | 10/1969 | Zimmerman | 229/915 |
| 3,667,598 | 6/1972 | Zelnick | 206/497 |
| 3,704,823 | 12/1972 | Howe | 229/915 |
| 3,784,082 | 1/1974 | Hurlock | 229/915 |
| 3,955,677 | 5/1976 | Collingwood | 206/453 |
| 4,027,817 | 6/1977 | Fremion | 206/586 |
| 4,180,164 | 12/1979 | Durden et al. | 206/593 |
| 4,360,145 | 11/1982 | Wilcox | 206/586 |
| 4,422,549 | 12/1983 | Werkheiser | 206/821 |
| 4,545,482 | 10/1985 | Nouatay | 206/586 |

FOREIGN PATENT DOCUMENTS

| | | |
|---|---|---|
| 0199336 | 10/1986 | European Pat. Off. . |
| 2845691 | 5/1980 | Fed. Rep. of Germany . |
| 2910329 | 9/1980 | Fed. Rep. of Germany . |
| 8315958 | 4/1984 | Fed. Rep. of Germany . |
| 8633285 | 4/1987 | Fed. Rep. of Germany . |
| 2416625 | 8/1979 | France . |
| 178101 | 10/1977 | New Zealand . |
| 194713 | 12/1982 | New Zealand . |
| 194790 | 2/1983 | New Zealand . |

*Primary Examiner*—David T. Fidei

*Attorney, Agent, or Firm*—Cushman, Darby & Cushman

[57] ABSTRACT

Skeleton packs that are designed for compression loading where such packs are themselves to be grouped, as in pallet loads, having a base to receive the primary packages and a rear member to take vertical load.

7 Claims, 3 Drawing Sheets

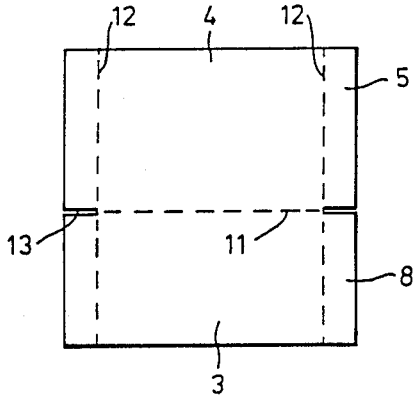
Fig.3.
Fig.4.
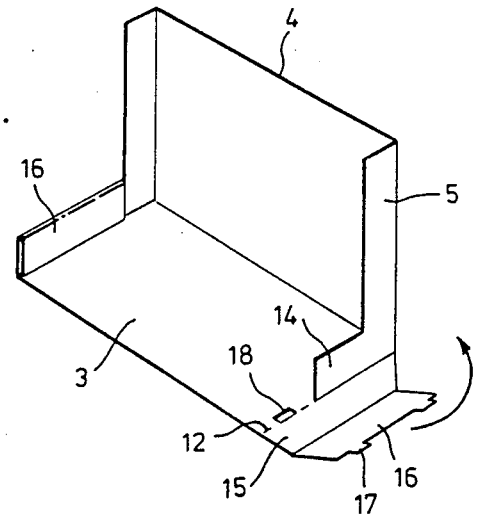
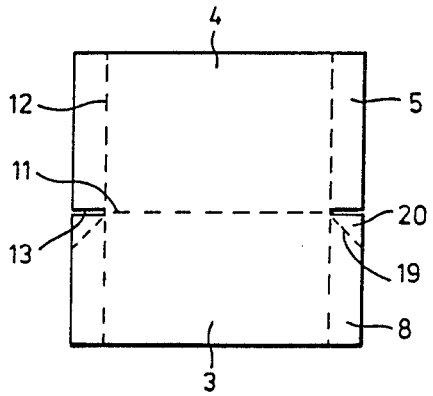
Fig.5.

Fig. 6.
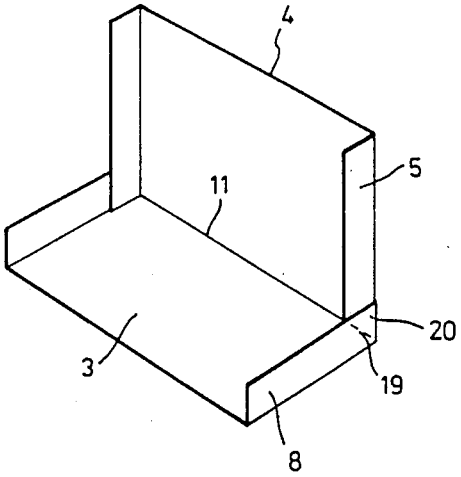
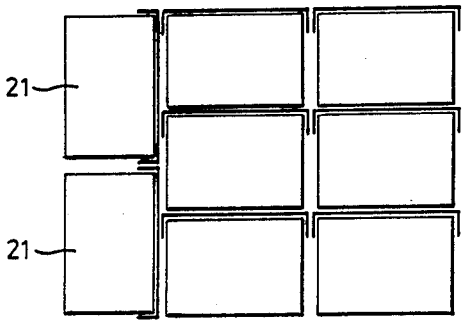
Fig. 7.
Fig. 8.
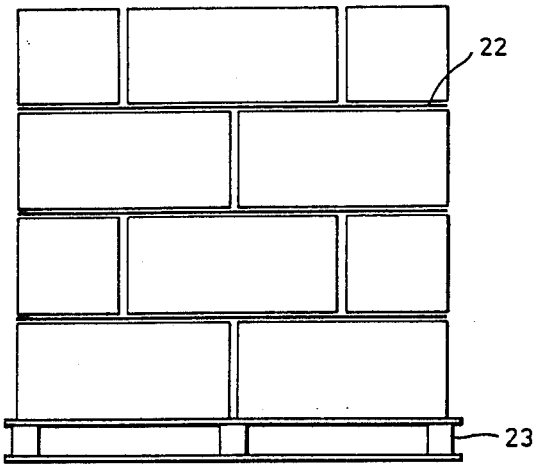

PACKAGING CONSTRUCTION

This invention relates to the packaging of a plurality of discrete containers to form unitary packages and to palletising these.

BACKGROUND OF THE INVENTION

Individual containers of various sizes and made of e.g. cartonboard or plastics materials, so-called primary packs, are commonly grouped together in a fibreboard case, or secondary packing, for distribution purposes. A fibreboard case provides compression strength additional to that of the plurality of individual containers in the case as well as giving added protection by way of puncture resistance. Fibreboard cases are also readily conveyed and handled by mechanical handling equipment and offer the maximum surface area for displaying printed matter. Nevertheless fibreboard cases can represent a significant additional packaging cost over the cost of the individual container cost and many proposals have been made for reducing the area of fibreboard required in a case in order to reduce the total packaging cost. For example, where the individual containers such as cans or bottles have adequate compression strength it can be more economical to provide a multiple package comprising a shallow fibreboard tray enveloped with a plastics film to retain the containers in place. On the other hand, particularly where the individual containers have little or insufficient compression strength or a shallow tray is otherwise inadequate, various skeletal case designs have been proposed such as in U.S. Pat. No. 3,425,544 and U.S. Pat. No. 2,868,429 having two upstanding walls the full height of the package but these approach a full case again in concept.

Skeleton packs have also been proposed where compression strength is not important, for example in French No. 79 02523 (publication No. 2 416 625), where packages are held in a two sided pack of a bottom member and rear member by one or more straps formed out of the material of the pack itself. These packs have a sloping top flange on to the rear member shaped to the primary packs, which take the load in any stacking.

We have sought to maximise the material saving in skeleton packs that are designed for compression loading and have seen that where such packs are themselves to be grouped, as in pallet loads, a base to receive the primary packages and a rear member to take vertical load are in essentials all that is needed. If the packs are placed with the front of one adjacent to the back of the next, the rear member in effect acts as part of both packs as far as taking vertical loads goes.

SUMMARY OF THE INVENTION

Accordingly the invention provides a pallet load or other assembly of secondary packs each comprising a single base panel terminating in a free front edge, a single vertical panel having a free top edge and connected to the base panel by a fold line between the rear edge of the base panel and the bottom edge of the vertical panel, and two vertical flanges, each having one free side edge and free top and bottom edges, each directly connected to opposite side edges of the vertical panel by a fold line extending along a respective side edge of the vertical panel and a respective side edge of a vertical flange, the vertical flanges each having a side-to-side width between the free side edge and respective fold line side edge over at least part of their top-to-bottom height less than the front-to-rear depth of the base panel, the pack being made of compressive loadbearing material so that the vertical panel and vertical flanges combine to resist deformation under vertical load, wherein each secondary pack is filled with a group of primary packages and the packs are disposed in the assembly in tiers so that within each tier the vertical panel of each secondary pack of a substantial number of the packs is adjacent the free front edge of the base panel of the next pack, the vertical panels and flanges of the secondary packs in a given tier combining to support the packs in the next tier with at most only partial reliance on load bearing by the primary packages.

This allows each pack to save for example 40 or 50 to 70%, more usually 55 to 65% of the area of material of a corresponding standard pack with a compensating increase in weight of the material of for example up to 130% compared with the weight used for standard packs. (Weight is conventionally given as Kg. weight/1000 sq.m. and is a measure of the strength of the material).

Conveniently said packs are so disposed that the lines of contact between adjacent packs within a tier are staggered as between one tier and the next, or a load pad separates tiers, or use is made both of staggering and of a load pad.

The cost savings are of course not generally as great as the savings in area of material because unless a corresponding standard or full pack has been unnecessarily strong, material of greater weight than for a full pack has to be used, but according to the kind of primary packages intended and the strength needed within the load (for example for stacking or non-stacking of pallets, or individual handling or container carriage), cost savings available are up to 50% or even more. Even when cost savings are lower, for example down to 7% or 8%, they are still very significant on large production runs on the low profit margins common in packaging.

A table of examples of the relation for particular cases and primary packs (back member on long side of base) is:

| Case size (mm) | Board area saving | Weight increase required in board | Corresponding cost saving |
|---|---|---|---|
| A. Base 470 × 240 Height 180 | 61% | Up to 126% | Up to 39% |
| B. Base 320 × 240 Height 140 | 65% | Up to 126% | Up to 50% |
| C. Base 570 × 155 Height 225 | 56% | Up to 85% | Up to 32% |
| D. Base 367 × 200 Height 289 | 63% | Up to 126% | Up to 42% |

The above are simply examples of what can be achieved, without restriction of the invention to any particular set of figures. The saving in area of material is as against a standard case, that is to say a case with four sides and with the top and bottom of overlying pairs of centrally meeting flaps provided on the top and bottom of opposing sides. The compensating increase in board weight is in relation to the board weight used in a standard pack for the same primary packs and vertical load, for packs surrounded by others.

While the invention primarily lies in the complete pallet load or the like, it can also be regarded as lying in the packs, whether as such or filled with primary packages.

Thus according to a further aspect of the present invention, there is provided a secondary pack for a group of primary packages, comprising a single base panel terminating in a free front edge, a single vertical panel having a free top edge and connected to the base panel by a fold line between the rear edge of the base panel and the bottom edge of the vertical panel, two vertical flanges, each having one free side edge and free top and bottom edges, each directly connected to the vertical panel by a fold line extending along a respective side edge of the vertical panel and a respective side edge of a vertical flange, the vertical flanges each having a side-to-side width between the free side edge and respective fold line side edge over at least part of its top-to-bottom height less than the front-to-rear depth of the base panel, the secondary pack being made of compressive load bearing material so that the vertical panel and flanges combine to resist deformation under vertical load.

In a preferred embodiment, the secondary pack may have two base flanges, each having free side edges and a free top edge, each connected to the base panel by a fold line between a respective side edge of the base panel and the bottom edge of a respective base flange; the base flanges assisting in locating a group of primary packages on the pack and in stiffening the base panel.

According to a second further aspect of the present invention there is provided such a pack when in use with a group of primary packages, the pack having the base panel co-extensive with the base of the group and the vertical rectangular panel of a height not less than the height of the group; the flanges extending only partly across the respective face of the group; and retaining means retaining the group of primary packs in position on the secondary pack.

The secondary pack can be folded from a flat sheet of material such as corrugated fibreboard and uses a minimum of board area and hence can be provided at minimum cost. Because the flanges extend up the vertical panel they provide the maximum reinforcement to the vertical panel and themselves contribute significantly to the compression strength of the package. As discussed above, the grade or weight of board necessary to provide the package with the same compression strength as a full case is obviously greater than that of the case but many primary packs are such that they provide a contribution to stacking strength and the necessary increase in board weight and cost per unit area may be as little as 20%. If however the contribution provided by the primary packs is ignored it can readily be found that comparable stacking strengths are achieved between a full case and a secondary pack according to the invention if the weight of board for the secondary pack is 60% greater than that of the case. Since in such an example the board area required may be only about 45% of the area required for a case there is a good saving in cost of the fibreboard. Part of this saving is lost in providing the retaining means but the overall savings afforded by packages according to the invention as compared to a full case are still considerable.

The base panel provides a level underside to the package enabling the package to be conveyed on standard conveying equipment.

The flanges on opposite edges of the base panel assist in locating the group on the secondary pack prior to any retaining means being applied and stiffen the base panel.

The flanges on the base panel and vertical panel can be secured together in overlapping relation, e.g. by gluing or stitching to maintain the vertical panel perpendicular to the base panel. Alternatively the flanges on one of the base or vertical panels can be provided with locking flaps adapted to fold over extension flaps on the other of the flanges and be secured to the panel on which they are provided. In yet another variation the flanges on the base and vertical panels can be connected together whilst allowing the secondary pack to be folded flat with the vertical panel overlapping the base panel for transport to the filling point where the package is made.

The size of a package is usually determined by factors such as the number of primary packs normally sold as a unit and the physical size and weight that can be conveniently handled. For a majority of packages for distribution to the retail trade it has been found that the flanges on the vertical panel should be between 20 mm and 60 mm preferably 40 mm. Flanges on the base panel are conveniently likewise dimensioned.

When the package is to be placed, for example, on a supermarket shelf, and depending upon the size, inherent stability and arrangement of the primary packs to form the group, it may be desirable for the flanges to extend across up to about 50% or even 60% of the respective faces of the group to retain the group of primary packs in position when the retaining means is removed. This increases the board area required for the secondary pack but the larger flanges can contribute to the compression strength and the cost of the increased board area be at least partly offset by a reduction in grade of board.

The retaining means can comprise a plastics film and the plastics film can be a stretchwrap film or a shrink film which is heated to shrink around the group of primary packs and secondary pack after it has been applied. Alternatively the retaining means can be one or more straps of suitable material.

The packages can be arranged in tiers of lines and rows and the tiers stacked above one another. The packages in each tier can be arranged in the same pattern of lines and rows as the adjacent tier or the packages of one tier can be arranged to overlap the packages of an adjacent tier. A layer pad comprising a flat sheet of board material may be interposed between each tier of packages in a stack.

A stack of packages can be loaded on a fork lift truck pallet and pallets so loaded can be stacked one upon another.

BRIEF DESCRIPTION OF THE DRAWINGS

The invention will now be more particularly described with reference to the accompanying diagrammatic drawings in which:

FIG. 3 is a plan view of a blank for the support member (secondary pack) of the package of FIG. 2;

FIG. 4 is a perspective view of a further embodiment of support member;

FIG. 5 is a plan view of a blank for another embodiment of support member;

FIG. 6 is a perspective view of the support member formed from the blank of FIG. 5;

FIG. 7 is a plan view of an assembly of packs and primary packages according to the invention; and FIG. 8 is a side elevation of an assembly of packs and primary packages according to the invention.

DESCRIPTION OF THE PREFERRED EMBODIMENTS

Figure 1:
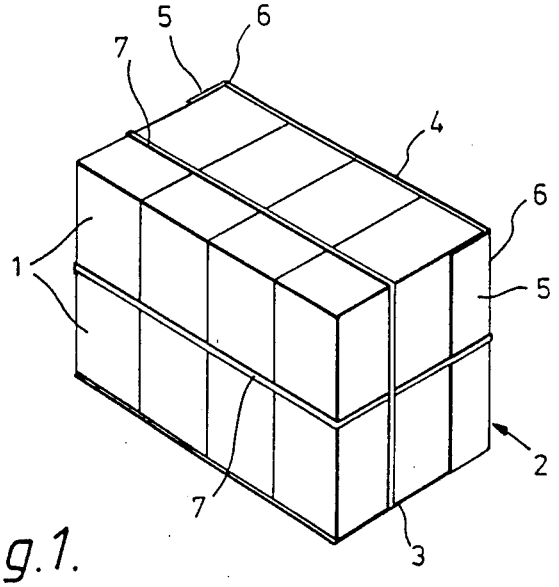
FIG. 1 is a perspective view of a first embodiment of a package (assembly of primary packages and a secondary pack) according to the invention.

Referring to FIG. 1 there is shown a package comprising eight primary packs 1 in the form of cartonboard containers. The primary packs are disposed in two tiers on a corrugated fibreboard support member 2 (also referred to as a pack or secondary pack) having a base panel 3 and a vertical panel 4 foldably connected thereto, the height of the vertical panel corresponding to the height of the group of primary packs. Flanges 5 foldably connected to opposite vertical edges 6 of the vertical panel extend the height of the vertical panel and partly across the respective faces of the group of primary packs. Two straps 7 retain the support member around the group of primary packs.

Figure 2:
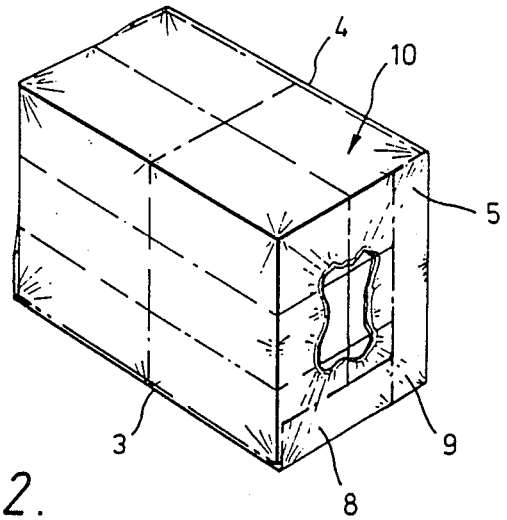
FIG. 2 is a perspective view of a second embodiment of a package according to the invention.

In the embodiment shown in FIG. 2 the support member comprises a base panel 3, vertical panel 4 and flanges 5 on the vertical panel as in FIG. 1 but additional flanges 8 are provided on the opposite edges of the base panel 3 to extend partly across the respective faces of the group of primary packs. The flanges 5 and 8 overlap at 9 adjacent the fold line connecting the base panel and the vertical panel and are secured together by glue. The support member is retained around the primary packs 1 by a shrink film 10.

FIG. 3 shows the blank for the support member of FIG. 2 having a base panel 3 foldably joined by fold line 11 to vertical panel 4. The side flanges 5 and 8 foldably joined by fold lines 12 to the vertical and base panels respectively are separated by slots 13 to allow the blank to be erected. As shown, base panel 3 terminates in a free front edge, and vertical panel 4 has a free top edge, i.e., the free edges have no pack structure extending beyond the defined edges or out of the plane of the panel of which the defined edge forms a part. The blank can be erected and glued either prior to a group of primary packs being disposed on the support member so formed or the blank can be erected and glued around a group of packs.

It will be appreciated that the blank area for the support member is considerably less than that required for a case which would completely enclose the primary packs. If the area of board for a case is taken as 100 then the board area of the support member is 45. Nevertheless to retain a similar compression strength the grade of board used for the support member must be increased. In a trial two empty cases were stood side by side and found to have a compression strength of 300 kg before deformation beyond the recovery point was created. A similar trial was then conducted with two support members of comparable size according to the invention placed side by side with the vertical panels spaced apart by the width of the base panel. Flanges were provided on both the vertical and base panel, those on the vertical panel each having a width corresponding to about 20% of the width of the base panel. It was found that a compression strength of 300 kg was achieved if the grade of board used for the support member was 50% increased in weight i.e. approximately 50% extra in cost per unit area over that used for the case. Thus whereas the cost of a case can be considered as $100 \times 100$ (area $\times$ cost per unit area) i.e. 10,000 the cost of a support member can be considered as $45 \times 160$ i.e. 7,200, that is 72% of the cost of the case for the same compression strength a saving of 28%. Allowing for the cost of the retaining means the total cost of a package according to the invention is about 23% less than that of a case.

The above comparisons ignore any contribution to the compression strength of the primary packs. Where the primary packs can contribute to compression strength it has been found possible to use somewhat lighter grades of material for the support member and achieve even greater cost savings Referring now to FIG. 4 there is shown an embodiment of support member which is particularly convenient for hand erection. The flanges 5 on the vertical panel 4 are provided with extension flaps 14 and the flanges on the base panel are formed by an outer flange 15 and an inner flange 16. Tongues 17 on the distal edge of the inner flanges 16 engage in slots 18 in the base panel adjacent the fold line 12 to lock the inner flange in position. When locked in position the extension flaps 14 of the flanges 5 are secured between the inner and outer flanges 16, 15 to maintain the support member erected.

A further alternative blank for a supporting member is shown in FIG. 5 in which similar parts of the blank are identified as described with reference to FIG. 3. In the embodiment of FIG. 5 diagonal fold lines 19 delimiting triangular portions 20 are provided in the flanges 8 extending from the intersection of the slots 13 with the fold lines 12 to the edges of the blank. To erect this blank the flanges 5 and 8 are folded through 180° to overlie the respective vertical and base panels and the portions 20 folded back through 180° along the fold lines 19. Glue can then be applied to the exposed surfaces of the portions 20 and the vertical panel 4 and base panel 3 folded together along fold line 11 to bring the flanges 5 into contact with and secured by the glue to the portions 20.

In this flat condition the support member is readily transported to the filling point where the support member can be erected by folding the base and vertical panels along line 11 through 90° to open the support member. By virtue of the glued connection between the flanges 5 and the triangular portions 20 this will automatically erect the flanges into the desired positions and the flanges 5 snapped into place with their bottom edges engaging the upper surface of the base panel as shown in FIG. 6.

The embodiment of FIGS. 5 and 6 thus provide a support member which is pre-glued and readily erected for use at a filling station.

FIG. 7 shows packages according to the invention arranged in one example of many possible manners of arranging a tier of such packages. The particular arrangement of lines and rows adopted would depend upon the dimension of the packages concerned and in the example illustrated it will be understood that in an adjacent tier the packages 21 on the left hand side could be arranged on the right hand side to obtain a more stable stack.

In the stack of packages shown in FIG. 8 a layer pad 22, a single flat sheet of fibreboard material, is interposed between each tier of packages. This layer pad can prevent the packages of one tier crushing or otherwise damaging packages in the tier below. The necessity for such layer pads depends upon the weight of the packages and the number of stacks to be placed one upon the other in storage. As shown in FIG. 8 the stack of packages can be disposed on a fork lift truck pallet 23 and may be retained thereon by straps or plastics film as is well known in the art.

In one example a package was formed using the support member (secondary pack) of FIGS. 2 and 3 and disposed therein were 24 primary packs each comprising one 1-lb weight of frozen peas tightly enclosed in a plastic bag. The bags were arranged upright in two rows of 12 packs and the package enclosed in a stretch-wrap plastics film. The support member was of corrugated fibreboard having B fluting 112 g/m$^2$, the outer liner being 200 g/m$^2$ Kraft and the inner liner being of the same weight but of non Kraft or substitute fibreboard material.

The package had a height of 180 mm a length of 470 mm and a width of 240 mm. The vertical flanges had a width of 40 mm, i.e. about 16% of the width of the base panel.

By comparison the groups of primary packs had previously been packed in corrugated fibreboard case of the same fluting and liner materials but the inner and outer liners were both 150 g/m$^2$.

Thus the total liner board weight for the support member was 400 g/m$^2$ as compared to 300 g/m$^2$ i.e. an increase of 33% (The primary packs contributed to the stacking strength). Thus with a board area some 45% of that of the case the cost saving on the fibreboard content of the package is some 50%.

The packages were arranged in a stack on a pallet, the stack having 5 tiers of packages each of 12 packages. The total weight of the pallet load was therefore 1440-lb. No damage was found to any of the packages after transporting the pallet load by road from the filling point to a distribution location.

I claim:

1. A pallet load or other assembly of secondary packs each comprising a single base panel terminating in a free front edge, a single vertical panel, having a free top edge, connected to the base panel by a fold line between the rear edge of the base panel and the bottom edge of the vertical panel, and two vertical flanges, each having one free side edge and free top and bottom edges, each directly connected to opposite side edges of said vertical panel by a fold line extending along a respective side edge of said vertical panel and a respective side edge of a vertical flange, said vertical flanges each having a side-to-side width between said free side edge and respective fold line side edge over at least part of the their top-to-bottom height less than the front-to-rear depth of said base panel, said pack being made of compressive load-bearing material so that said vertical panel and vertical flanges combine to resist deformation under vertical load, wherein each said secondary pack is filled with a group of primary packages and said packs are disposed in the assembly in tiers so that within each tier, the vertical panel of each secondary pack of a substantial number of said packs is adjacent the free front edge of the base panel of the next pack, the vertical panels and flanges of said secondary packs in a given tier combining to support the packs in the next tier with at most only partial reliance on load bearing by said primary packages.

2. An assembly of secondary packs according to claim 1, wherein each said pack saves 40 to 70% of the area of material of a corresponding standard pack with a compensating increase in strength of the material up to 130%.

3. An assembly of secondary packs according to claim 1, wherein said packs are disposed so that lines of contact between adjacent packs within a tier are staggered as between one tier and the next.

4. A secondary pack for a group of primary packages, comprising a single base panel terminating in a free front edge, a single vertical panel, having a free top edge, connected to the base panel by a fold line between the rear edge of the base panel and the bottom edge of the vertical panel, two vertical flanges, each having one free side edge and free top and bottom edges, each directly connected to said vertical panel by a fold line extending along a respective side edge of said vertical panel and a respective side edge of a vertical flange, said vertical flanges each having a side-to-side width between said free side edge and respective fold line side edge over at least part of its top-to-bottom height less than the front-to-rear depth of said base panel, said secondary pack being made of compressive load bearing material so that said vertical panel and flanges combine to resist deformation under vertical load.

5. The secondary pack of claim 4 and having two base flanges, each having free side edges and a free top edge, each connected to the base panel by a fold line between a respective side edge of the base panel and the bottom edge of a respective base flange; said base flanges assisting in locating a group of primary packages on said pack and in stiffening the base panel.

6. The secondary pack of claim 5, wherein said flanges on said base panel and said vertical panel are secured together in overlapping relation to maintain said vertical panel perpendicular to said base panel.

7. An assembly of secondary packs according to claim 1 wherein a load pad separates tiers.

* * * * *